United States Patent [19]

Turnbull

[11] 3,952,226

[45] Apr. 20, 1976

[54] CRT COMPRISING STRONTIUM METAL GETTER FILMS AND METHOD OF PREPARATION

[75] Inventor: John Coryell Turnbull, Lancaster, Pa.

[73] Assignee: RCA Corporation, New York, N.Y.

[22] Filed: Dec. 13, 1974

[21] Appl. No.: 532,729

Related U.S. Application Data

[62] Division of Ser. No. 394,841, Sept. 6, 1973.

[52] U.S. Cl. ..... 313/481; 313/174; 313/178

[51] Int. Cl.[2] ..... H01J 19/70

[58] Field of Search ..... 313/174, 178, 481

[56] References Cited

UNITED STATES PATENTS 2,843,777 7/1958 Szegho ..... 313/466

3,153,190 10/1964 Spalding ..... 313/174 X

*Primary Examiner*—R. V. Rolinec
*Assistant Examiner*—Darwin R. Hostetter
*Attorney, Agent, or Firm*—G. H. Bruestle; L. Greenspan

[57] ABSTRACT

Apertured-mask cathode-ray tube comprises a strontium metal getter film on at least a portion of the electron-beam-receiving surface of the mask. The method comprises sealing into the tube a mass comprising a strontium-aluminum alloy, heating the mass above 1100°C until a substantial proportion of the strontium is liberated and vaporized, and condensing the vaporized strontium as a metal film on internal surfaces of the tube.

3 Claims, 2 Drawing Figures

CRT COMPRISING STRONTIUM METAL GETTER FILMS AND METHOD OF PREPARATION

This is a division of application Ser. No. 394,841, filed Sept. 6, 1973.

BACKGROUND AND SUMMARY OF THE INVENTION

This invention relates to a novel cathode-ray tube and to a novel method for producing a getter metal film in a cathode-ray tube.

In order to maintain an adequate vacuum in an apertured-mask cathode-ray tube, it is the practice to produce a thin film of barium metal on inner surfaces of the tube envelope and on the electron-beam-receiving surfaces of the mask. Such a film may be produced by exothermic or endothermic reactions or both as described for example in U.S. Pat. Nos. 3,381,805, 3,385,420 and 3,389,288. The barium metal films getter, or capture, residual gases in the tube at the time of film deposition and subsequently during the operating life of the tube. A barium-metal-coated mask emits a continuous spectrum of x-rays when bombarded by electron beams, which spectrum is characteristic of a barium target. As the apertured-mask cathode-ray tube art has developed, higher acceleration voltages (above 20,000 volts) and greater electron-beam currents are being used. As a result, more X-rays are being generated with consequent hazard to the viewer.

The present invention is based on the realization that, while strontium metal films can getter residual gases as predicted, they generate fewer X-rays than barium metal films when bombarded by electron beams. Strontium metal also possesses properties which provide additional valuable advantages both to the method of producing the getter film and to the tube employing the getter metal film. Thus, the novel tube comprises a strontium metal film on at least a portion of the electron-beam-receiving surface of the apertured mask of the tube.

Strontium metal has a vapor pressure of about 100° torr at about 1107°C, whereas barium requires a temperature of 1430°C (323°C higher) to achieve the same vapor pressure. A vapor pressure of at least 100 torr is what is required for producing a getter metal film of necessary thickness in a vacuum. Thus, the novel method employs a strontium-aluminum alloy containing about 40 weight parts strontium metal and about 57 to 63 weight parts aluminum metal. Thereby, lower temperatures may be used for producing the strontium metal film, resulting in fewer reject tubes.

Where the strontium metal film resides on surfaces that are struck by primary electron beams, a lesser amount of X-radiation is generated than with barium metal surfaces. Also, since strontium metal films absorb less energy from impinging electron beams, a luminescent target coated with a getter metal film is excited to a greater brightness for the same power input than with a barium metal film of the same thickness.

DESCRIPTION OF THE PREFERRED EMBODIMENT

Figure 1:
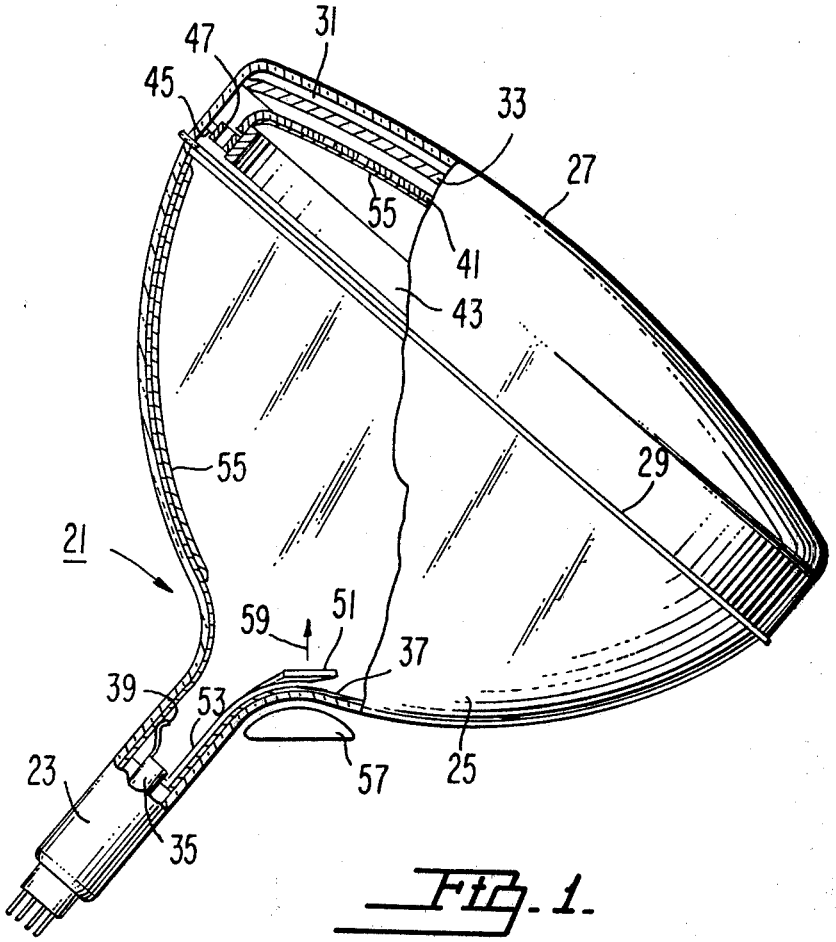
FIG. 1 is a partially broken-away longitudinal view of a novel cathode-ray tube of the invention.

The cathode-ray tube illustrated in FIG. 1 is an apertured-mask-type color television picture tube of the 25V90° size. The tube includes an evacuated envelope designated generally by the numeral 21, which includes a neck 23 integral with a funnel 25, and a faceplate or panel 27 joined to the funnel 25 by a seal 29, preferably of devitrified glass. There is a luminescent layer 31 of phosphor material on the interior surface of the faceplate 27. There is a light-reflecting metal coating 33, as of aluminum metal, on the luminescent layer 31. The luminescent layer 31, when suitably scanned by an electron beam or beams from a gun in a mount assembly 35 located in the neck 23, is capable of producing a luminescent image which may be viewed through the faceplate 27.

Closely spaced from the metal layer 33 toward the mount assembly 35 is a metal mask 41 having a multiplicity of apertures therein. The mask 41 is welded to a metal frame 43, which is supported by springs 47, which are attached to the frame 43, on studs 45 integral with the panel 27. There is an electrically conductive internal coating 37 on a portion of the interior surface of the funnel 25 between the mount assembly 35 and the seal 29. Three metal fingers 39 space the mount assembly 35 from the neck wall and connect the forward portion of the mount assembly 35 with the interior coating 37.

A getter metal container 51 is located on the outward flare of the funnel 25 and within the envelope 21. An antenna spring 53 supports the getter metal container 51 from the mount assembly 35 and holds the container 51 against the internal coating 37. A strontium metal film 55 is shown deposited on the conductive coating 37 and on the gun side of the mask 41. Inasmuch as the invention is concerned primarily with the strontium metal film 55 and the method for producing that film, a detailed description of the components and parts normally associated with the neck and faceplate 23 and 27 is omitted. In operation, this tube employs an acceleration voltage of about 25,000 volts between the mask 41 and the gun.

The tube of FIG. 1 may be fabricated by methods known in the art. The various parts are assembled at atmospheric pressure. Then the entire tube is baked at about 400°C, the envelope 21 exhausted by pumping, and then sealed from the atmosphere. After the sealed envelope is cooled to room temperature, an RF induction heating coil 57 is placed adjacent the funnel 25 opposite the getter metal container 51 as shown in FIG. 1. The coil 57 is energized so as to heat the container 51 and its contents until the strontium metal in the container vaporizes and travels in the direction of the arrow 59 and deposits as a film 55 on the internal surfaces of the tube. A detailed description of a suitable getter metal assembly and its method of use appears in U.S. Pat. No. 3,558,961 to E. M. Palsha et al.

In this example, the tube is assembled having a getter metal container 51 containing a compressed mass of about 250 milligrams of strontium in a chemically-stable mixture consisting essentially of 56.6 weight percent nickel metal powder and 43.4 weight percent of an alloy consisting essentially of about 60 weight parts aluminum metal and 40 weight parts strontium metal. The strontium-aluminum alloy and the mixture with nickel metal powder are quite stable for long periods of time in normal atmosphere even at temperatures up to 600°C. When the RF coil 57 is placed adjacent the funnel 25 and energized as described above, the container 51 is heated to about 750° to 850°C, at which point the nickel-and-alloy mixture reacts generating heat. This heat, plus heat generated from RF energy produced before, during and after flashing, liberates and vaporizes strontium metal in the direction of the arrow 57. The strontium metal vapor deposits as a film 55 on the internal surfaces of the tube. The total RF heating time is about 25 seconds and rises to a maximum temperature of about 1250°C. The nickel-and-alloy mixture reacts after about 7 to 8 seconds of this heating time.

GENERAL CONSIDERATIONS

The example employs a strontium-aluminum alloy plus nickel metal particles to produce an exothermic reaction upon heating to about 800°C. While not preferred, one may omit the nickel metal powder and cause the liberation of strontium metal from the alloy by endothermic reaction. One may use 0 to 60 weight parts nickel metal, preferably 53 to 60 weight parts, to about 43 weight parts alloy. The lower the ratio, the less exothermic the mixture. Theoretically, the strontium metal vapor may be derived from any source. However, a strontium-aluminum alloy is the only source known which provides the shelf life and chemical stability during storage and tube manufacture required for cathode-ray-tube making.

The strontium-aluminum alloy is believed to be constituted of a compound $SrAl_4$ with about 5 to 15 weight percent of aluminum metal. This alloy is similar in some respects to the barium-aluminum alloy used for producing getter metal films in cathode-ray tubes. However, the strontium-aluminum alloys contain higher proportions of aluminum and, when used with nickel metal powder, require higher proportions of nickel metal to release equivalent amounts of strontium.

It is preferred in the novel method to use only strontium and no barium in the getter container mixture. However, small amounts up to 10 atomic percent barium and 90 percent strontium can be tolerated. Any larger amount requires the higher evaporation temperature and longer heating times of the barium alloy and barium metal, and the deposited films have less of the desirable X-radiation characteristics of strontium metal. Also, the strontium metal films produced should not contain more than 10 atomic percent of barium metal.

The Table compares various properties of strontium metal and barium metal. It will be noted that barium requires 1430°C to produce a vapor pressure of 100 torr, whereas strontium requires only 1107°C (323°C lower) to produce the same vapor pressure. A vapor pressure of at least 100 torr is required for producing a practical getter metal film in cathode-ray tubes in a practical production time. Even with a lower vapor pressure of 10 torr, strontium metal requires 260°C lower temperature than does barium metal. The difference in required temperature to achieve a desired vapor pressure can be traded off with shorter times and higher temperatures to produce the desired film, or with reduced RF power input and lower maximum temperature as illustrated in FIG. 2.

Figure 2:
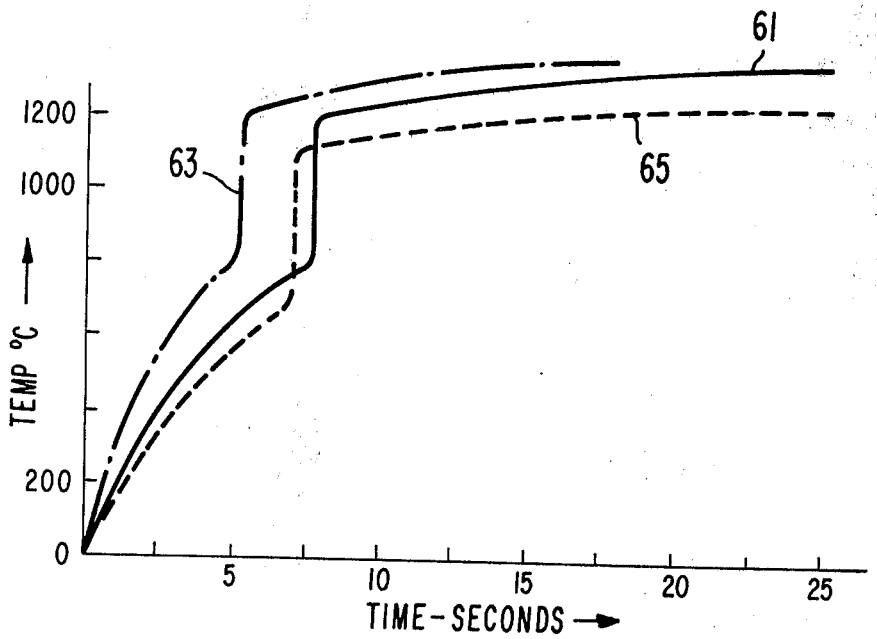
FIG. 2 is a family of curves comparing the flash characteristics of a barium-aluminum getter with those of a strontium-aluminum getter.

In FIG. 2, the curve 61 shows a normal time and temperature relationship for an exothermic getter mixture of 50 weight percent nickel powder and 50 weight percent barium-aluminum alloy in a tube such as that shown in FIG. 1. Flash occurs in about 8 seconds after RF heating starts, and RF heating is completed about 25 seconds after starting, achieving a maximum temperature of about 1350°C. The curve 63 is for an identical system and procedure except that a strontium-aluminum alloy is substituted mol-for-mol for the barium-aluminum alloy. In the curve 63, the getter mixture flashes sooner and the heating reaches 1350°C sooner, in about 18 seconds. By reducing the RF power input, the heating time can be raised to 25 seconds with the same SrAl alloy-and-nickel mixture, as shown by the curve 65. An equivalent amount of strontium metal is evaporated with less RF power, and a lower maximum temperature is required. These results can be further optimized by mixture in the example.

Many advantages result from employing the lower maximum temperature. Fewer tubes are scapped due to glass cracks caused by neck and funnel glass that is contacted with the hot getter container assembly during flashing. Less gas is evolved by the heating of the funnel surfaces by the hot getter assembly during flashing. Fewer tubes are scrapped due to distortion of the antenna spring and getter metal container 51 caused by heating during flashing. Fewer tubes are scrapped due to loose particles and loose getter scrap during flashing.

In addition to the practical advantages to the method for producing a strontium metal film, strontium also has practical advantages in the film iself. A principal source of X radiation in a cathode-ray tube is the target surface, where X rays are produced by bombardment by the primary electrons of the beam during the tube operation. By the target is meant any surface which is struck by the electron beam during tube operation. In a shadow-mask tube such as that shown in FIG. 1, the principal target area is the mask 41 and the frame 43, which are constituted principally of iron metal. When a barium metal film is deposited on the mask and/or frame, the continuous X radiation produced by electron-beam bombardment is increased by a factor of about 2.15, which is equal to the ratio of the atomic number of barium with respect to iron. When a strontium metal film is deposited on the iron mask and/or frame, the factor is about 1.46. Thus the increase in continuous X radiation caused by a strontium metal film on the mask and/or frame is less than half that of a barium metal film. The relative amount of continuous X-radiation emitted from a strontium metal film bombarded by an electron beam compared to a barium metal film is 38/56, the ratio of the atomic numbers.

The distribution of metal over internal tube surfaces is more affected by gas present during flashing for strontium metal than for barium metal vapor. This is due to the lighter molecular weight of the strontium vapor molecules making it more susceptible to deflection and scattering. This effect produces a relatively greater amount of strontium metal on surfaces nearer the getter container, and relatively less strontium metal deposits on surfaces further away. For the X-radiation problem mentioned above, this effect is favorable and tends to produce less strontium metal on the mask and more strontium metal on the funnel surfaces nearer the getter container.

During flashing, some getter metal vapor passes through the apertures in the mask 41 and deposits upon the reflective metal layer 33. The effect of the getter metal film which deposits on the reflecting metal layer 33 is to reduce the energy of the primary electrons of the electron beam passing through it into the luminescent layer 31. Energy loss and hence loss in light output is proportional to the square root of the atomic number of the film. For metal films of the same thickness, strontium metal produces 17.6 percent less loss in light output than does barium metal. The light output loss is believed to be more favorable with strontium metal films because of the more favorable distribution mentioned in the paragraph above.

It has been suggested previously, in U.S. Pat. No. 3,153,190 to R. D. Spalding, to employ a mixed alloy of barium, strontium and aluminum. While this may produce a getter metal film with adequate gettering qualities, nevertheless the foregoing other properties are not realized. This is for the reason that when both strontium and barium are present together at the same temperature, strontium metal will vaporize and deposit first due to its higher vapor pressure. Then, barium metal will vaporize and deposit. Thus, the higher vaporization temperature of barium is still required in the process, and since the barium is last to deposit, the film will have the X-radiation characteristics of a barium metal surface and not a strontium metal surface. Small amounts of barium metal can be tolerated in the film used in the novel tube. The amounts of barium should be less than 10 weight percent of the total amount of barium and strontium present.

It has been suggested previously, in U.S. Pat. No. 2,843,777 to C. S. Szegho, to employ a strontium getter metal film in a cathode-ray tube. The tubes disclosed there do not employ a plurality of electron beams, an apertured mask, or acceleration voltages above 20,000 volts as in the novel tube. With lower beam currents and acceleration voltages, any X-radiation produced by the electron beam is easily absorbed by the envelope.

Also, this reference does not disclose the strontium-aluminum alloys and their admixture with nickel metal particles which are features of the method disclosed herein.

TABLE*

| | Sr | Ba |
|---|---|---|
| Melting Point (°C) | 770 | 729 |
| Boiling Point (°C) | 1375 | 1827 |
| Temperature to Provide Vapor Pressure of 10 Torr (°C) | 887 | 1147 |
| Temperature to Provide Vapor Pressure of 100 Torr (°C) | 1107 | 1432 |
| Relative X-Radiation Generation Compared to Iron Target | 1.46 | 2.15 |
| Relative Attenuation of Electron Beam | 82.4 | 100 |

*from "Vapor Pressure Curves of the Elements" Prepared by Richard E. Honig and Dean A. Kramer, copyrighted 1969 Radio Corporation of America

I claim:

1. A cathode-ray tube comprising an evacuated envelope, a luminescent viewing screen within said envelope, means for producing a plurality of electron beams within said envelope for exciting said screen to luminescence, and an apertured mask closely spaced from said screen within said envelope for selectively intercepting and transmitting portions of said electron beams, at least a portion of the electron-beam-receiving surface of said mask being coated with a film consisting predominantly of strontium metal.

2. The tube defined in claim 1 wherein said tube is adapted for normal operation with acceleration voltages for said beams of greater than 20,000 volts.

3. The tube defined in claim 1 wherein said film of strontium metal contains up to 10 atomic percent of barium metal.

* * * * *